US005564242A

United States Patent [19]

Larsen

[11] Patent Number: 5,564,242

[45] Date of Patent: Oct. 15, 1996

[54] EXPANSION JOINT MONITOR

[75] Inventor: John F. Larsen, Rockville, Md.

[73] Assignee: Larsen Products Corporation, Jessup, Md.

[21] Appl. No.: 253,280

[22] Filed: Jun. 2, 1994

[51] Int. Cl.[6] ..... E04B 1/684; G01D 5/00

[52] U.S. Cl. ..... 52/396.06; 52/396.03; 52/573.1; 116/283

[58] Field of Search ..... 52/396.01, 396.02, 52/396.03, 396.04, 396.05, 396.06, 396.07, 396.08, 396.09, 573.1, 105, 167.4, 167.9; 404/52, 57, 58; 116/281, 283, 200, 321, 323

[56] References Cited

U.S. PATENT DOCUMENTS 4,922,676 5/1990 Spronken ..... 52/396.05

5,140,932 8/1992 Goldfein et al. ..... 116/283

*Primary Examiner*—Michael Safavi

*Attorney, Agent, or Firm*—Watson, Cole, Grindle & Watson

[57] ABSTRACT

A pair of members which are expandable and contractible with temperature have a flexible expansion joint therebetween. A first body is attached to one of the members and carries an elongated support having a pair of indicators slidably mounted thereon. The indicators frictionally engage the support so that they move only in response to movement of the spaced members. A second body is attached to the other of the members and has a slot therein through which the support freely extends. The indicators have an outer dimension greater than the width of the slot. The second body has opposite faces which engage the indicators.

7 Claims, 2 Drawing Sheets

Fig. 3.
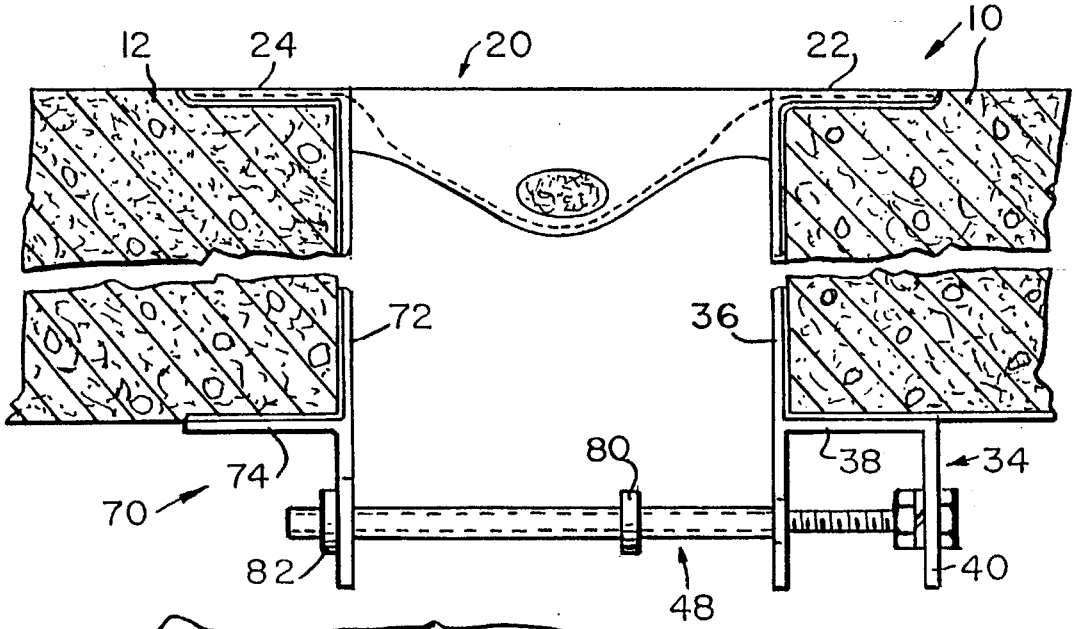
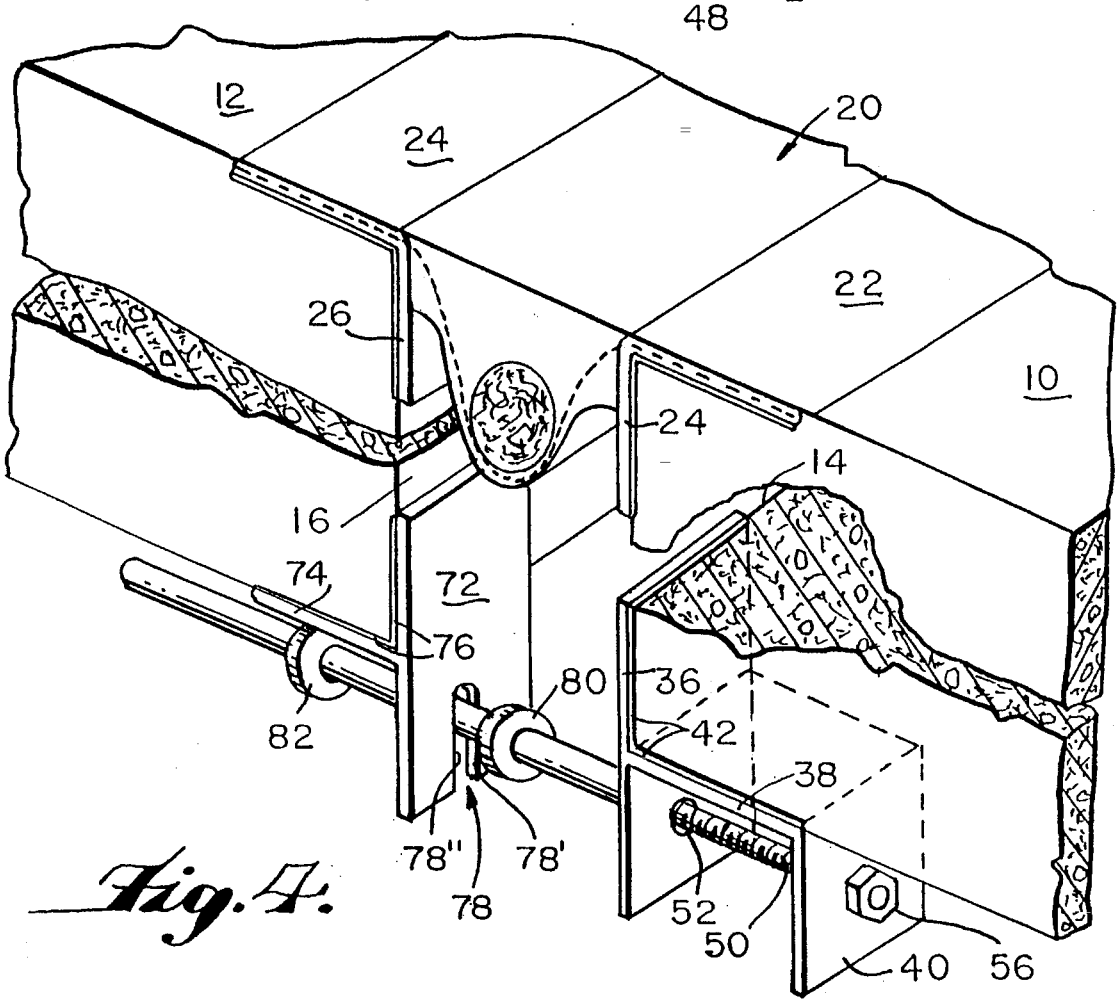
Fig. 4.

EXPANSION JOINT MONITOR

BACKGROUND OF THE INVENTION

The present invention relates to a monitor for expansion joints such as those utilized in parking garages wherein the concrete decks of the garage may typically have an expansion joint every fifty feet in order to accommodate the expansion and contraction of the concrete under different temperature conditions. The expansion joint opening is sealed for a variety of reasons. For example, it is sealed with a conventional flexible expansion joint to prevent water, salts debris and the like from passing through the opening to the space underneath. Furthermore, it is desirable to provide a an upper surface on the expansion joint which is relatively flush with the upper surfaces of adjacent concrete members so that no safety hazard is presented to persons wearing high heels or using wheelchairs. These expansion joints fail for a number of reasons, one being that they cannot accommodate the movement between the concrete members with which they are used.

Concrete, under controlled conditions, has a definable movement factor. The known coefficient of expansion and contraction of concrete, and the predictable high and low temperature range in the area where the concrete is placed, serve as a guide for engineers in determining the placement of the expansion joints and the size of the joint required to accommodate the predicted total movement due to expansion and contraction. There is a need for a device which will accurately monitor the movement of an expansion joint in order to determine whether or not the calculated and actual movements of the joint are the same. Furthermore, when rehabilitating and reinstalling failed expansion joints, it is important to know exactly how much total movement has occurred so that a new expansion joint can be installed which is designed to accommodate the known total movement.

The minimum opening between adjacent concrete members will, of course, occur on the hottest day of the year, while the maximum opening between adjacent concrete members will occur on the coldest day of the year. A person could go to an installed expansion joint and measure the gap on both the hottest and coldest day of the year to obtain this information, but such a procedure is not practical since it is impossible to predict when the hottest and coldest days of the year will occur. Furthermore, it is not practical to visit all of the existing expansion joints which may need future replacement. It is therefore a principal objective of the invention to provide a device for measuring total movement of an expansion joint which is simple and inexpensive in construction, yet which is durable and will provide very accurate information as to the total movement which has occurred during hot and cold weather throughout a period of a year or more.

SUMMARY OF THE INVENTION

The present invention is utilized with first and second concrete members which are spaced from one another, a conventional expansion joint being provided for sealing the opening between the concrete members. The invention comprises a first body which is attached to the first concrete member and a second body which is attached to the second concrete member. A support is carried by the first body, and a pair of spaced indicators are slidably mounted on the support. There is sufficient friction between the indicators and the support such that the indicators will move with respect to the support only in response to movement of the spaced concrete members to which the first body and the second body are attached. This is important since the indicators should not move in response to any other extraneous factors such as vibration of the concrete members in response to movement of vehicles thereover.

The second body includes a flattened portion which has oppositely facing surfaces. A slot is formed through the flattened portion, and the support extends through the slot. The width of the slot is such that the support extends freely through the slot. However, the outer dimension of the indicators is greater than the width of the slot. Accordingly, one of the oppositely facing surfaces of the second body is adapted to push one indicator in one direction, while the other of the oppositely facing surfaces of the second body is adapted to push the other of the indicators in the opposite direction.

The device may be left in position for a long period of time, and when inspected, the distance that the two indicators have moved from an initial position indicates the total movement of the concrete members and the associated expansion joint. The device therefore indicates the total distance of movement of the expansion caused by movement of the concrete members toward one another on the hottest day of the year and movement of the concrete members away from one another on the coldest day of the year.

The device is easy to install, and may be utilized with a conventional expansion joint. The device is maintenance free and substantially foolproof in operation.

BRIEF DESCRIPTION OF THE DRAWINGS

FIG. 3 is a similar sectional view showing the monitor in its position on the coldest day of the year; and FIG. 4 is a top perspective sectional view partially broken away showing the monitor in an intermediate position.

DESCRIPTION OF THE PREFERRED EMBODIMENT

Figure 1:
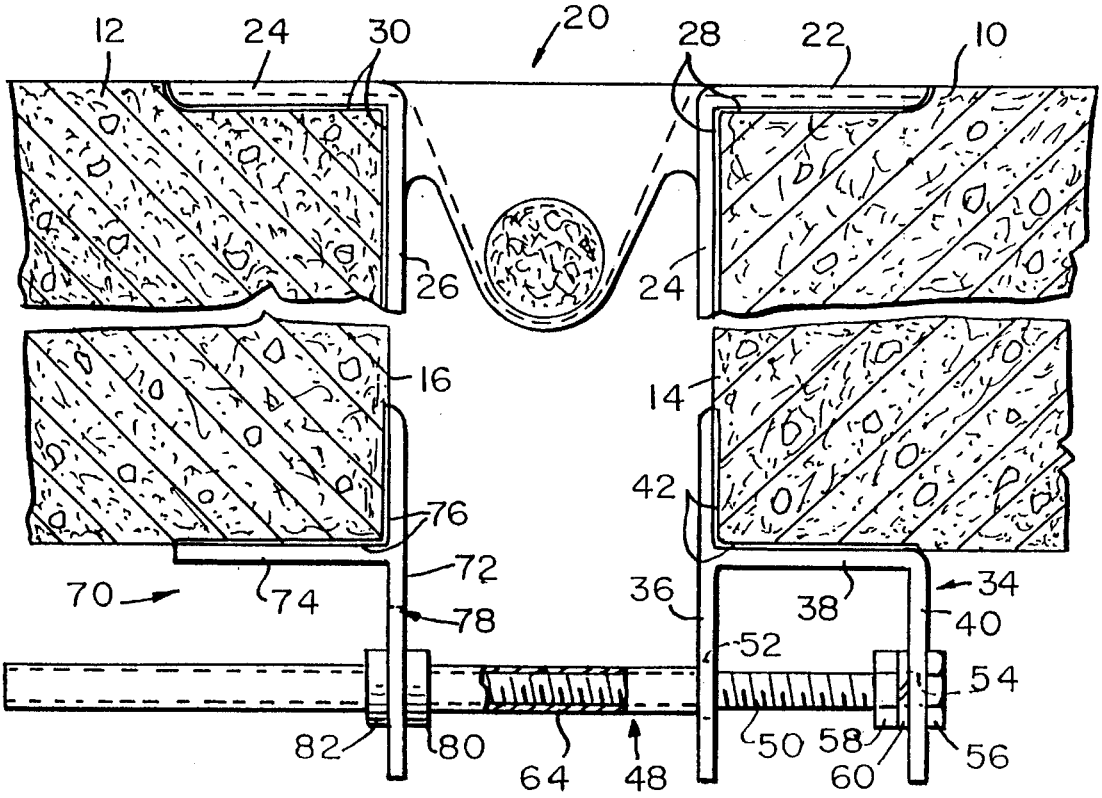
FIG. 1 is a sectional view showing the monitor in its initially installed position.

Referring now to the drawings wherein like reference characters designate corresponding parts throughout the several views, as seen most clearly in FIGS. 1 and 4, a pair of concrete members 10 and 12 have end surfaces 14 and 16 respectively which define an expansion opening therebetween. A conventional flexible expansion joint is indicated generally by reference numeral 20 and includes a pair of longitudinally extending shoulders 22 and 24 and wall portions 24 and 26 extending generally at right angles to the shoulders 22 and 24 respectively. The expansion joint is secured in the operative position illustrated by layers 28 and 30 of epoxy adhesive compound. The construction and manner of securing the expansion joint 20 in position are conventional.

The invention includes a first body 34 is formed of rigid material such as plastic which may be formed in one piece as shown or as a plurality of interconnected parts if so desired. Body 34 includes a first wall 36 joining a wall 38 extending at right angles to wall 36. Wall 38 joins a wall 40 which extends at right angles to wall 38 and parallel with wall 36. The right-hand facing surface of the upper part of wall 36 above wall 38 and the upwardly facing surface of wall 38 define adjacent surfaces disposed at an angle of about ninety degrees to one another for attaching body 34 to concrete member 10. A layer 42 of epoxy adhesive compound is disposed between these adjacent surfaces and the facing surfaces of the concrete member 10 to attach body 34 to the concrete member.

A support 48 is carried by body 34 and comprises a threaded stud 50 which extends freely through a hole 52 in the lower part of wall 36. As seen in FIG. 1, a hole 54 is formed through wall 40 and the right-hand end of the threaded stud extends through this hole. A conventional nut 56 is threaded on the outer end of the threaded stud, and a further nut 58 threaded on the stud presses a lock washer 60 against wall 40. It is evident that members 56, 58 and 60 cooperate to lock stud 50 in place on the wall 40 so that the stud extends substantially perpendicular to the wall. A layer of material 64 is disposed around the major portion of the stud to provide a generally cylindrical support surface on which the indicators hereinafter described are mounted. Material 64 may be of a suitable material to provide adequate friction with the indicators so that the indicators do not move with respect to the support except when the concrete members move relative to one another.

It should be understood that the support can be of different construction and may be formed of a single member rather than being formed of a plurality of members. The manner of connecting the support on body 34 may also be varied. The support may also be formed integral with body 34 if so desired. The particular construction of the support and manner of connecting it to body 34 have been described in connection with readily available components for the sake of simplicity, and can be varied so long as the support is movable with body 34 and is adapted to movably support indicators thereon in such a manner that the indicators move only when the concrete members move.

A second body 70 is also formed of a suitable rigid material such as plastic and may be formed in one piece as shown or as a plurality of interconnected parts if so desired. Body 70 includes a first wall 72 which joins with a wall 74 extending at a right angle thereto. The left-hand facing surface of the upper part of wall 72 above wall 74 and the upwardly facing surface of wall 74 define adjacent surfaces for attaching body 70 to concrete member 12. A layer 76 of epoxy adhesive compound is disposed between these adjacent surfaces and the facing surfaces of the concrete member 12 to attach body 70 to concrete member 12. A downwardly opening slot 78 is formed in wall 72 and the support extends through the slot.

A pair of similar indicators 80 and 82 are slidably mounted on the support. These indicators are annular in configuration and have central holes which receive layer 64 of the support therethrough. The indicators may be formed of plastic and have sufficient friction with layer 64 so that the indicators will only slide relative to the support when the concrete members move relative to one another.

Slot 78 is defined between opposite side edges 78' and 78" as seen in FIG. 4. These side edges are spaced from support 48 so that the support extends freely through the slot. However, the outer dimensions or diameters of indicators 80 and 82 are greater than the width of the slot so that the indicators cannot pass through the slot. The opposite faces of wall 72 therefore form indicator engaging portions which are adapted to move the indicators 80 and 82 in opposite directions as the associated concrete members move relative to one another.

OPERATION

When it is desired to monitor the total movement of an expansion joint such as employed in the deck of a parking garage, an unobtrusive location under the deck near the end of the expansion joint is selected. Although the invention allows for some deflection of the decks, a minimum amount of deflection should occur at the end of the joint. The bodies 34 and 70 are then attached to the spaced ends of the concrete members as shown in the drawings. The initial position of the device when installed is that shown in FIG. 1 wherein the indicators 80 and 82 are disposed in contact with the opposite parallel faces of wall 72 of body 70.

Figure 2:
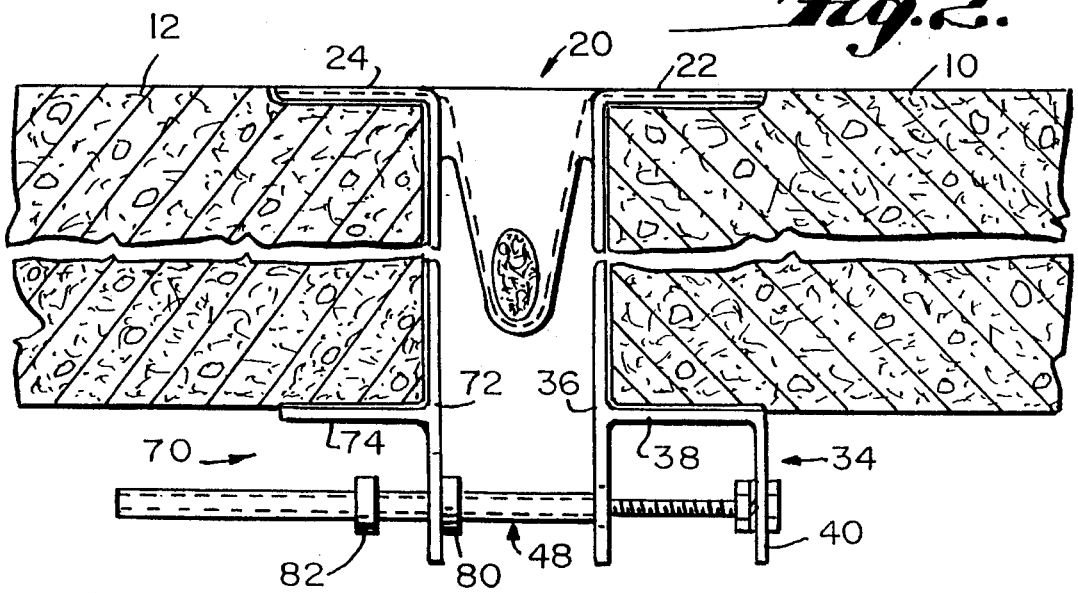
FIG. 2 is a similar sectional view showing the monitor in its position on the hottest day of the year.

It is assumed for the sake of discussion that the device is mounted in the operative position as shown in FIG. 1 at a time of the year when the temperatures are increasing from day to day. As the temperature increases, the concrete members move toward one another until the hottest day of the year occurs, whereupon the indicators are disposed in the position shown in FIG. 2. In this position, indicator 80 has been moved to the right from the position shown in FIG. 1 since it is pushed to the right by wall 72 as the concrete members move toward one another, and at the same time, the support has been moved to the left from the position as shown in FIG. 1, thereby causing indicator 80 to slide along the support to the position shown in FIG. 2.

As the temperatures decrease from the hottest day of the year, the concrete members will move away from one another. As this occurs, indicator 80 will remain in the position shown in FIG. 2 since wall 72 moves to the left away from the indicator, and the indicator remains in position on the support due to the friction between the indicator and the support. FIG. 4 illustrates an intermediate position wherein indicator 80 has been moved to its position on the support corresponding to the hottest day of the year, while indicator 82 has been moved to the left relative to the support from its initial position as shown in FIG. 1 due to movement of the concrete members away from one another on some days which were colder than the day on which the device was installed.

Referring to FIG. 3, the device is shown in the position which will occur on the coldest day of the year. As the concrete members move apart, wall 72 urges indicator 82 to the left, while the support is being moved to the right. It will be understood that temperatures greater than that of the coldest day of the year will cause the concrete members to move toward one another from the position shown in FIG. 3, and that indicator 82 will remain in the position shown due to friction between the indicator and the support.

In order to measure the total movement of the expansion joint during the entire period during which the monitor is installed in place, the distance between indicators 80 and 82 as shown in FIG. 3 is measured, since these positions represent the positions of the indicators 80 and 82 on the hottest and coldest days of the year respectively. After this measurement is taken, the thickness of wall 72 of body 70 must be subtracted since the indicators were initially spaced apart the thickness of wall 72 as seen in FIG. 1. When the thickness of wall is subtracted from distance between facing surfaces of the indicators, an accurate measurement of the total movement of the expansion joint is provided.

The invention has been described with reference to a preferred embodiment. Obviously, various modifications, alterations and other embodiments will occur to others upon reading and understanding this specification. It is our intention to include all such modifications, alterations and alternate embodiments insofar as they come within the scope of the appended claims or the equivalent thereof.

What is claimed is:

1. In combination, a pair of spaced members which are expandable and contractible with temperature changes, a flexible expansion joint disposed between and engaging said members, a monitor comprising a first body including an attaching portion for attaching the first body to one of said spaced members, a second body including an attaching portion for attaching the second body to the other of said spaced members, an elongated support carried by said first body, a pair of indicators being movably supported on said support for indicating total movement of said joint, said second body having separate indicator engaging portions thereon for engaging and moving different ones of said indicators with respect to said support.

2. The combination of claim 1 wherein each of said attaching portions comprises a pair of angularly related surfaces, and adhesive means attaching said attaching portions to the respective spaced members.

3. The combination of claim 1 wherein said support includes a generally cylindrical support portion, said indicators each comprising a generally annular member disposed in surrounding relation to to said cylindrical support portion.

4. The combination of claim 3 wherein said indicators are frictionally engaged with said cylindrical support portion so that the indicators will move with respect to said cylindrical portion only in response to movement of said spaced members.

5. The combination of claim 1 wherein said second body includes opposite sides, said indicators being disposed on opposite sides of said second body.

6. The combination of claim 1 wherein said indicator engaging portions of the second body comprises oppositely facing surfaces on the second body, one of said surfaces being engageable only with one of said indicators, the other of said surfaces being engageable only with another of said indicators.

7. The combination of claim 6 wherein said second body has a slot formed therethrough and opening at said surfaces, said slot having a width to permit said support to extend freely through said slot, said indicators having an outer dimension greater than the width of said slot so that the indicators cannot pass through said slot.

* * * * *